US006200084B1

(12) United States Patent
Self et al.

(10) Patent No.: US 6,200,084 B1
(45) Date of Patent: Mar. 13, 2001

(54) FORKLIFT ATTACHMENT FOR USE IN THE OPENING OF FIBER BALES

(75) Inventors: William Thomas Self, Franklinton; William R. Perkinson, Warrenton; Michael L. Ryder, Littleton, all of NC (US)

(73) Assignee: Peck Manufacturing, Inc., Charlotte, NC (US)

( * ) Notice: Subject to any disclaimer, the term of this patent is extended or adjusted under 35 U.S.C. 154(b) by 0 days.

(21) Appl. No.: 09/330,416

(22) Filed: Jun. 11, 1999

(51) Int. Cl.[7] ..... B66F 9/18
(52) U.S. Cl. ..... 414/607; 414/412
(58) Field of Search ..... 414/607, 412

(56) References Cited

U.S. PATENT DOCUMENTS

| | | | | |
|---|---|---|---|---|
| 3,071,268 | * | 1/1963 | Wales | 414/607 |
| 3,242,851 | | 3/1966 | Brawley et al. . | |
| 3,556,328 | | 1/1971 | Miles et al. . | |
| 3,949,890 | | 4/1976 | Keller . | |
| 4,348,801 | | 9/1982 | Dumont et al. . | |
| 4,615,656 | | 10/1986 | Geraghty, Jr. . | |
| 4,850,087 | | 7/1989 | Gronau . | |
| 4,929,141 | | 5/1990 | Keesey et al. . | |
| 5,069,596 | | 12/1991 | Mueller et al. . | |
| 5,156,516 | | 10/1992 | Boisseau . | |
| 5,199,841 | | 4/1993 | Von Gehlen . | |
| 5,318,399 | | 6/1994 | Marom . | |
| 5,371,938 | | 12/1994 | Martin . | |
| 5,445,490 | * | 8/1995 | Whitehead | 414/607 |

FOREIGN PATENT DOCUMENTS

| | | | | |
|---|---|---|---|---|
| 2428773 | * | 1/1976 | (DE) | 414/607 |
| 35 40 191 A1 | | 5/1987 | (DE) . | |
| 0 260 914 A2 | | 3/1988 | (EP) . | |
| 2639932 | * | 6/1990 | (FR) | 414/607 |
| 2 228 917 | | 9/1990 | (GB) . | |
| 63-307033 | * | 12/1988 | (JP) | 414/607 |
| 3-289429 | * | 12/1991 | (JP) | 414/607 |
| 89/08015 A1 | | 7/1989 | (WO) . | |
| 92/05103 A1 | | 4/1992 | (WO) . | |

* cited by examiner

*Primary Examiner*—Steven A. Bratlie
(74) *Attorney, Agent, or Firm*—Alston & Bird LLP

(57) ABSTRACT

An attachment for securement to a forklift and for use in severing the bands surrounding fiber bales is described. The attachment includes a blade and a coupling device for releasably securing the blade to the arm of a conventional forklift. The arms of the forklift can then be pressed toward each other in the manner in which they are used to grip a bale, such that the blades sever the bands surrounding the bale. The blades are desirably V-shaped, and one can be provided on each of the forklift arms. The attachment can be used to sever the bands of one fiber bale at a time, or can be used to simultaneously sever the bands surrounding two adjacent fiber bales.

8 Claims, 6 Drawing Sheets

FORKLIFT ATTACHMENT FOR USE IN THE OPENING OF FIBER BALES

BACKGROUND OF THE INVENTION

1. Field of the Invention

The invention generally relates to an apparatus for facilitating the opening of bales of fibers. More specifically, the invention relates to an attachment for use in combination with conventional forklifts which can be used to safely and efficiently sever the bands typically surrounding bales of textile fibers during their transport so that the fibers may be accessed for use.

2. Description of the Prior Art

Fibrous materials, and in particular staple textile fibers such as those of cotton, other natural fibers and synthetic fibers are commonly provided in the form of large bales which are surrounded by a plurality of bands which serve to keep the fibers in compacted bale form during their transport and storage. For example, on a typical 500 pound fiber bale, as many as seven or more bands may extend horizontally around the fiber bale, while another two or more extend in an opposite (e.g. vertical) direction. Because the bales of fibers must be equipped to withstand numerous stages of transport and storage, the bands are typically formed of a strong and durable material such as metal.

Although the fibers are tightly compacted during the baling process, when the bands are tightly secured about the fibrous material, some of the fibers can tend to extend outwardly around the tight bands, similar to the manner in which a pillow would extend outwardly about a rubber band fastened tightly around it. As a result, the bands can be somewhat difficult to remove when the time comes for the fibers to be used.

Heretofore, the bands have generally required manual removal by an operator, who typically strikes the bands with an axe or other sharp object to sever them so that the fibers can be utilized. Because the bands are under tremendous tension due to the tightness with which they are secured and the force of the compressed fibrous material wanting to expand outwardly, the cut ends have a tendency to fly outwardly when the bands are severed. Where manual band removal is employed (e.g. such as by a worker contacting the bands with a swing axe), the person severing the bands must necessarily be close to the bands in order to reach them with the cutting implement. As should be readily apparent, this can present a significant risk to the person severing the bands, as he may be struck by one of the flying ends. Furthermore, because several swings of the axe or other implement may be required for band severing to be successfully achieved, many injuries are realized through the laborer's repeated swinging of the implement, such as back and arm injuries. In addition, because the fibrous material has a tendency to extend outwardly around the tightly wrapped bands, it may be difficult for the operator to properly contact the band with the cutting implement. As a result, plural axe swings may be required to achieve successful severing of a single band.

Attempts have been made to provide more efficient and safe methods for severing the bands around fiber bales. For example, U.S. Pat. No. 4,929,141 to Keesey et al. describes a method for removing all packaging, including bands, from a fiber bale. In the method described in the Keesey patent, the fiber bale to be opened is conveyed between two walls, and one wall pushes the bale against the other while a retractable blade cuts the bands. As will be recognized by those of skill in the art, this method requires the purchase and maintenance of a separate piece of equipment, as well as requiring the use of valuable facility space.

U.S. Pat. No. 5,199,841 to Von Gehlen describes an apparatus for severing straps around a fiber bale. The patent describes two specific embodiments of the invention: in the first, a cutting device rolls along the top of the bale in order to sever the bands which surround it. In the second embodiment, a cutting wheel is mounted to a wall and a bale is lifted by a forklift and pressed against the cutting device so that the cutting device severs the bands surrounding the bale. Therefore the invention requires, in each of the embodiments, a cutting device supported in some region of the facility. As a result, it likewise requires the use of facility space and specific floor arrangements of the facility equipment.

U.S. Pat. No. 5,318,399 to Marom describes an apparatus for removing the ties and wrappers from textile fiber bales. The device utilizes a fixed spike wheel which cuts the bands as the bale is conveyed past the cutting wheel.

European Patent No. 0260914 to Goldman describes a process for removing straps from a bale of cotton which includes the steps of transporting the bale to an impact cutter having a long horizontal cutting blade, and pushing the bale toward the blade, to thereby sever the bands which surround it. Similarly, German Reference No. DE3540191A1 to Hergeth illustrates a forklift carrying a bale to an impact cutter in order to sever the bands which surround it.

U.S. Pat. No. 3,949,890 to Keller describes a rotatable forklift construction which can be used by an operator to lift and rotate a banded bale, so that he can then manually clip the bands surrounding the bale.

U.S. Pat. No. 5,445,490 to Whitehead describes a device for carrying bales of paper and cutting the wires which surround them. The device includes a forklift arm having a concave bearing surface and a retractable blade which can be triggered by way of a lever, so that the blade travels forward to sever the wire surrounding the bale.

SUMMARY OF THE INVENTION

The instant invention avoids these risks of injury through the provision of attachments which can be readily secured to a conventional forklift, so that the force of the forklift arms closing together can itself be used to sever the bands extending about the fiber bales. Furthermore, the attachments are adapted for removable securement to the arms of a conventional forklift such that the forklift does not incur damage or require extensive modification and can be readily returned to its normal state without the attachments. In addition, in one aspect of the invention, an attachment can be secured to each of the forklift arms so that the forklift can be used to simultaneously sever the bands surrounding each of two adjacent fiber bales.

The attachments of the instant invention are desirably designed for ready and easy attachment to the arms of a conventional forklift. Each of the attachments desirably includes a support, a coupling device for securing the support to an arm of a forklift, and a blade secured to the support. In use, the support is preferably secured to the arm of a forklift so that the blade is facing inwardly toward the second arm of the forklift. In this way, the force of the forklift arms being closed together serves to press the blade into the bands such that the bands are readily and easily severed. In a preferred form of the invention, the attachments are provided in pairs, with one attachment being positioned on each arm of a forklift such that the blades face inwardly toward each other in the direction of the gripping motion of the forklift. With the attachments properly positioned on the forklift, the forklift can therefore squeeze one bale to sever the bands at two sides of the bale, or the forklift can be used to simultaneously sever the bands on two side-by-side bales of fibrous material.

Because the forklift operator is spaced from the bale(s) (and thus the bands) by both the dimension and the physical presence of the forklift, the risk of his being contacted by the flying band ends during the band severing process is virtually eliminated. Furthermore, because the mechanical force itself of the forklift arms closing together is used to sever the bands, the risks to the operator associated with the swinging action of the axe or other cutting implement are also reduced. Also as noted, because a blade can be provided on each of the two arms of a conventional forklift, two side-by-side bales can be opened simultaneously in one forklift closing operation where desired. In addition, in the fiber bale examples described above which have a number of bands in a horizontal direction and a relatively small number of bands extending in the opposite direction, the attachment of the instant invention can be used to sever the bands going in one direction (e.g. the horizontal direction), while leaving the remaining small number of bands in the other direction for use in transporting and/or positioning the bale while in its semi-opened form. Alternatively, the bales can be turned and the forklift can be used to sever all of the bands surrounding them.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1B:
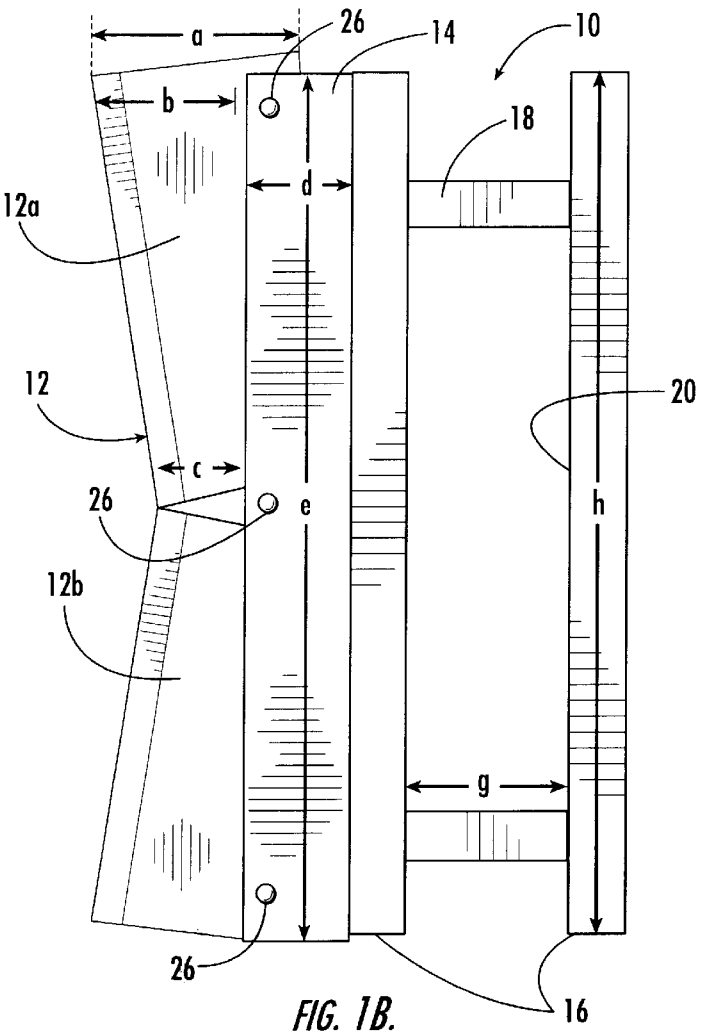
FIG. 1B is a side plan view of the attachment shown in FIG. 1A, illustrating the opposite side of the invention.
Figure 1A:
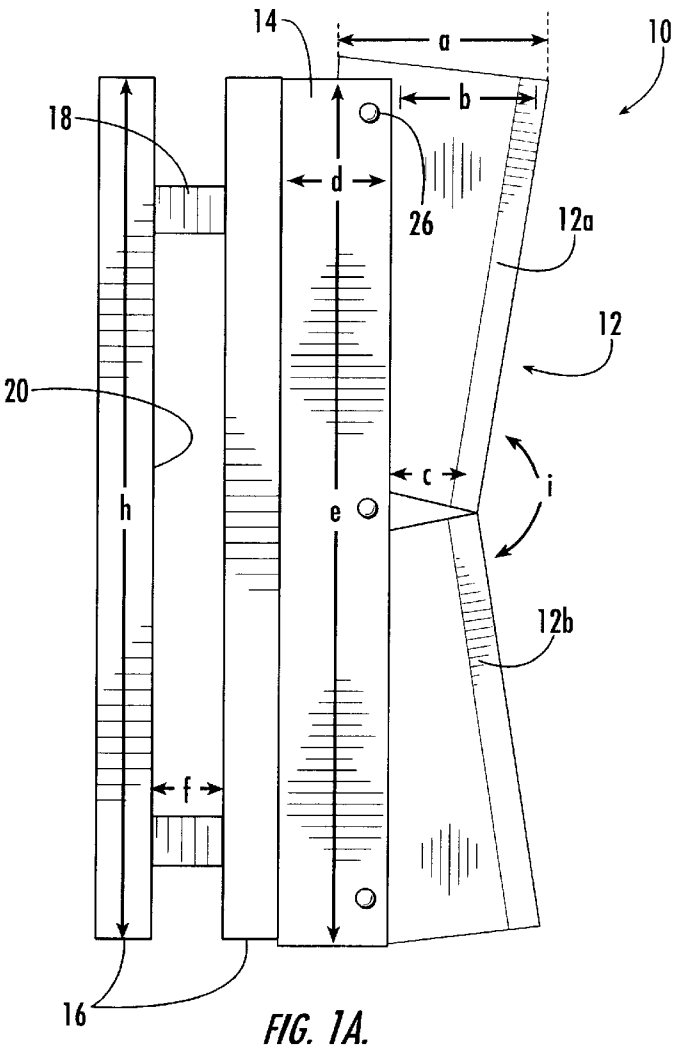
FIG. 1A is a side plan view of a forklift attachment according to one embodiment of the instant invention from one side of the device.

With reference to the drawings, FIGS. 1A and 1B illustrate an attachment 10 according to the instant invention, shown generally at 10. As illustrated, the attachment includes a blade 12, a support 14 for the blade, and a coupling device 16 for securing the supporting device and blade to an arm of a conventional-type forklift (particularly of the type commonly used to lift and transport bales of fibrous material).

Figure 5:
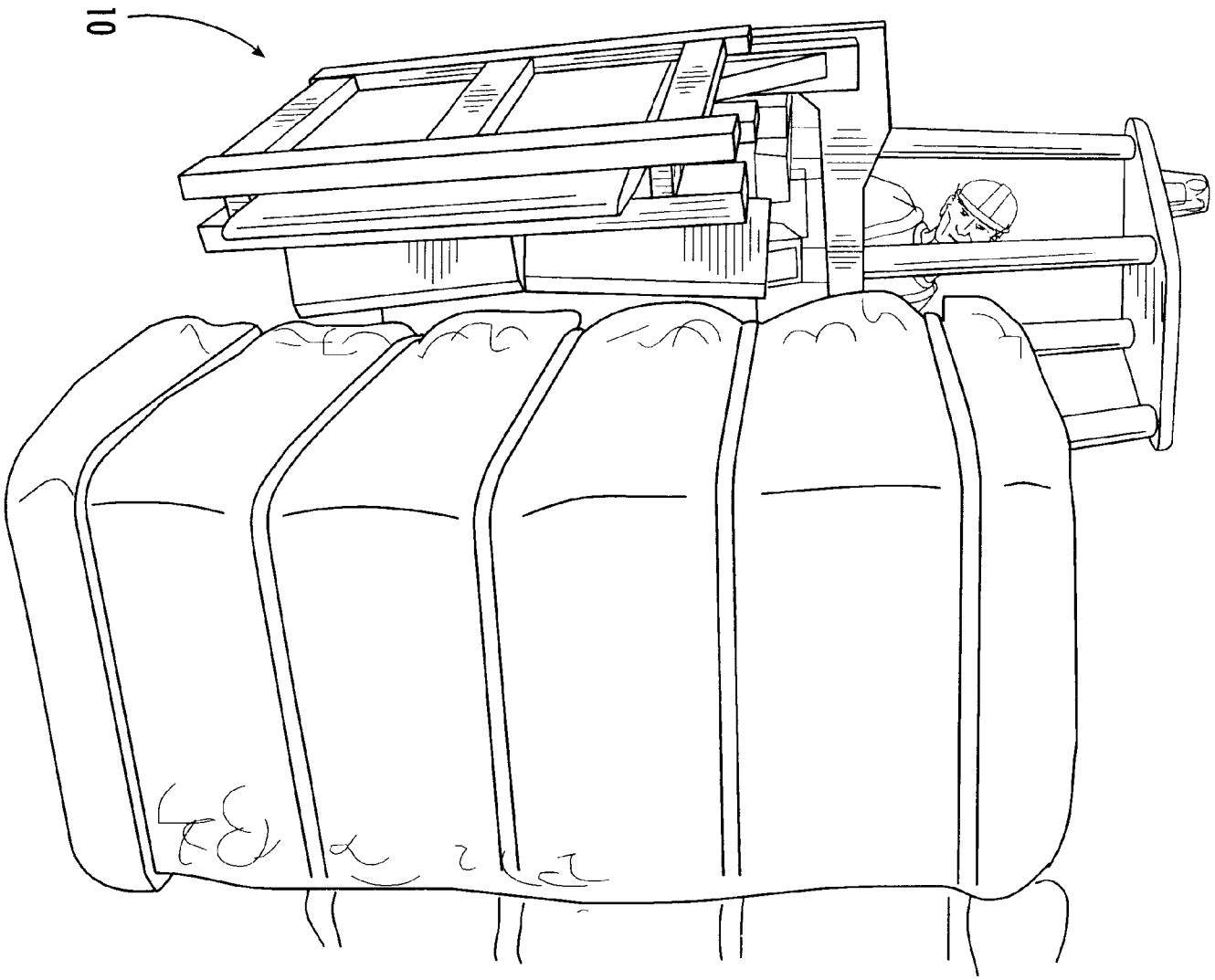
FIGS. 5 and 6 are environmental views illustrating a conventional forklift using the device of the present invention for opening fiber bales.
Figure 6:
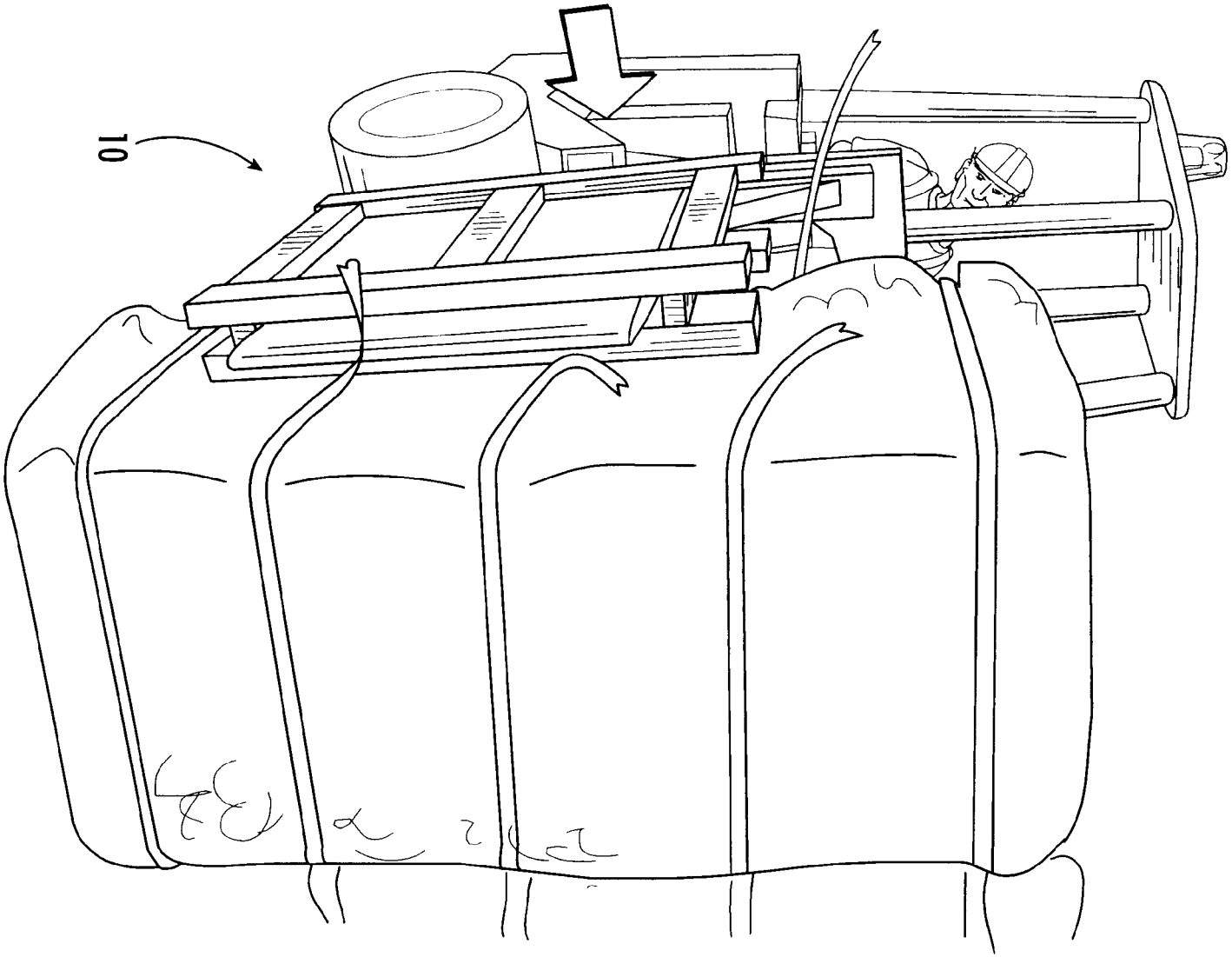

In a preferred form of the invention, the coupling device 16 is designed to removably secure the blade 12 to the arm of the forklift, so that it can be selectively attached to and removed from the forklift arm in a quick and easy manner. For example, in a preferred embodiment of the invention, the coupling device 16 is in the form of a bracket 18, which has a slot 20 for receiving an arm of a forklift. In a preferred aspect of this embodiment of the invention, the bracket 18 has a generally rectangular slot, which is adapted to correspond to the shape of a conventional forklift arm, with such arms typically having a generally rectangular cross-section, as can be seen in FIGS. 5 and 6. As will be appreciated by those of skill in the art, this configuration assists in providing a close fit between the attachment and the forklift arm.

The coupling device 16 also desirably includes a means for tightly securing it to the arm of the forklift, so that the attachment can be prevented from incurring undesirable movement relative to that of the forklift arm when the combination is used to sever the bands around fiber bales. For example, in the illustrated embodiment of the invention, the means for tightly securing the bracket 18 to the forklift arm is in the form of a T-shaped pin 22 and orifice 23 combination. In this embodiment of the invention, the pin 22 is inserted into an orifice 23 in the coupling device 16 or support 14 and preferably also through an underlying corresponding coaxial orifice in the forklift arm (not shown). Alternatively, the pin could extend through an orifice in the coupling device so that it presses against an upper edge of the forklift arm, to thereby stabilize the attachment 10 from undesirable relative motion with respect to the forklift arm. However, it is noted that other forms of securement, including but not limited to screws, bolts, clamps, grips, inserts, and other types of fasteners, could be used within the scope of the instant invention, so long as the method of securement stabilizes the attachment from movement relative to the forklift arm during the band severing operation. It is also to be noted, however, that because in most cases the upper edge of the forklift arm will be substantially planar and extend substantially parallel to the ground (i.e., so that gravity tends to pull the upper portion of the slot 20 against the upper edge of the forklift arm), the weight of the attachment 10 itself may function to stabilize the attachment from movement relative to the forklift arm, rendering supplemental securement means unnecessary. In most cases, however, in the interest of safety, it will be desirably to provide a supplemental securement means such as those described.

The blade 12 is desirably generally V-shaped, so that the portions of the blade proximate the edges of the support 14 protrude to a greater extent than the central portion of the blade. For example, it has been found that a blade 12 which extends outwardly from the support 14 about 3 inches at its most prominent points, and about 2 inches at its least prominent point performs well in the instant invention. Among other things, this enables the blade 12 to contact the bands at an angle, which has been found to provide superior band severing results. Not only does an angled blade have a tendency to provide a more effective band cut, but also in situations where the very edge of the blade contacts the band to be severed, the angle directs the band inwardly toward the blade rather than allowing it to slip outwardly from the blade edge. In embodiments where a generally V-shaped blade is used, the cutting edge defines an obtuse angle, preferably having an angle of about 145 to about 175 degrees, and more preferably, about 160 degrees.

In one aspect of the invention, the blade 12 is formed from two distinct blade sections 12*a,* 12*b,* which cooperate to form the generally V-shaped blade. However, it is noted that other blade configurations and constructions could also be used within the scope of the instant invention. For example, the generally V-shaped blade can be provided in the form of a single piece rather than as separate blade sections. The blade 12 can be made from any durable cutting material, and will be selected to provide ready and easy cutting of the band material for which the attachment is expected to be used in cutting. For example, it has been found that metal and/or alloy blade materials such as the type used in the manufacture of wood chipper blades perform well in the production of blades designed for use in cutting metal bands.

The blade 12 can be secured within the support 14 in any manner which provides effective securement thereof; preferably such securement is performed such that the blades can be removed for sharpening or replacement. For example, in the illustrated embodiment, the blade 12 is secured to the support 14 by way of nuts and bolts 24, which extend through orifices 26 in the support 14, and corresponding orifices in the blade (not shown). However, other forms of securement such as clamps, grips, pins, or the like can be used within the scope of the instant invention, provided such enables the secure attachment of the blade 12 to the support 14.

The support 14 can be secured to the coupling device 16 in any conventional manner, such as by welding, soldering, adhesive attachment, bolts, or the like. Alternatively, the support 14 could be integrally formed with the coupling device.

Figure 2:
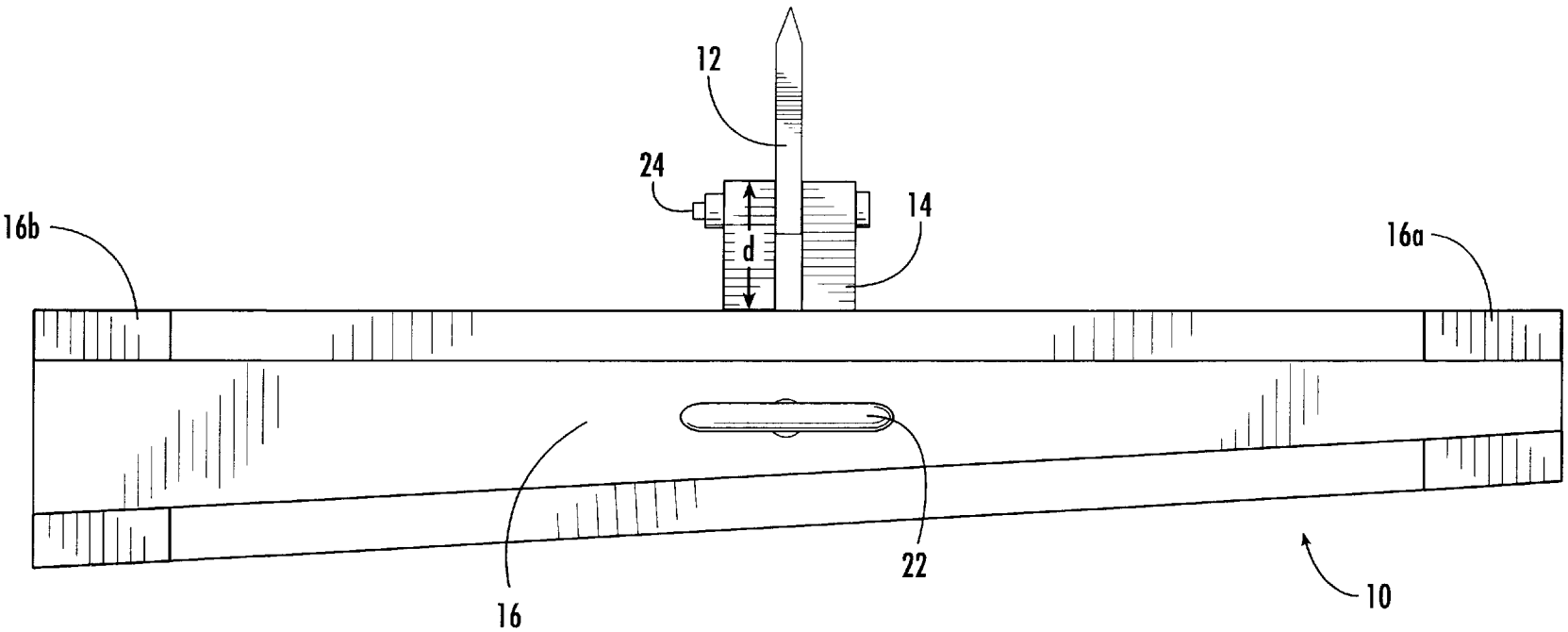
FIG. 2 is an overhead plan view of the attachment shown in FIGS. 1A and 1B.

As illustrated, in certain embodiments of the invention, it is desirable to have the slot 20 in the bracket 18, which is adapted to receive the arm of the forklift, taper in its slot width, so as to provide a close and secure fit with the forklift arm by corresponding to the shape of the forklift arms (which are often tapered) and to facilitate insertion of the forklift arm into the slot. For example, as illustrated in particular in FIGS. 1*a,* 1*b* and 2, the slot 20 can taper outwardly from a first relatively narrower end (illustrated in FIG. 1A) having a width f to a relatively wider end (illustrated in FIG. 1B) having a width g. Accordingly, the coupling device 16 will have a narrower end 16*a* and a wider end 16*b* (FIG. 2). However, other slot shapes could be used within the scope of the instant invention, so long as they provide secure attachment of the apparatus to the forklift arm. Furthermore, although the bracket 18 can be formed from a plurality of bars in the manner shown, it is to be noted also that the bracket could be formed from a single continuous piece of material, etc., within the scope of the instant invention, and can be integrally formed or formed from a plurality of individual pieces which are joined together.

One example of relative dimensions of the parts of the attachment 10 which has been found to perform well in connection with a conventional forklift is described as follows. However, it is noted that other individual dimensions and relative dimensions can be used within the scope of the instant invention, these dimensions just being exemplary, and, as will be recognized by those of ordinary skill in the art, the invention would have utility in combination with a variety of commercially available forklifts. However, in one aspect of the invention, the generally V-shaped blade 12 can have a width a at its widest point of about 5 inches, and be secured within the support 14 such that about 1½ to 2 inches of the depth of the blade is held within the support. In this way, a sufficient portion of the blade 12 is rigidly held within the support 14 to provide a stable cutting edge, while a width b of about 2½ to 3 inches of the blade extends outwardly from the support at the widest extent of the blade proximate the ends thereof. Because of the shape of the blade, it extends outwardly from the support 14 a distance c of about 2 inches at its narrowest extent. The angle formed by the cutting edge of the substantially V-shaped blade is preferably therefore an obtuse angle i, and in particular one having an angle of about 145 to about 175 degrees, and more preferably about 160 degrees.

Figure 3:
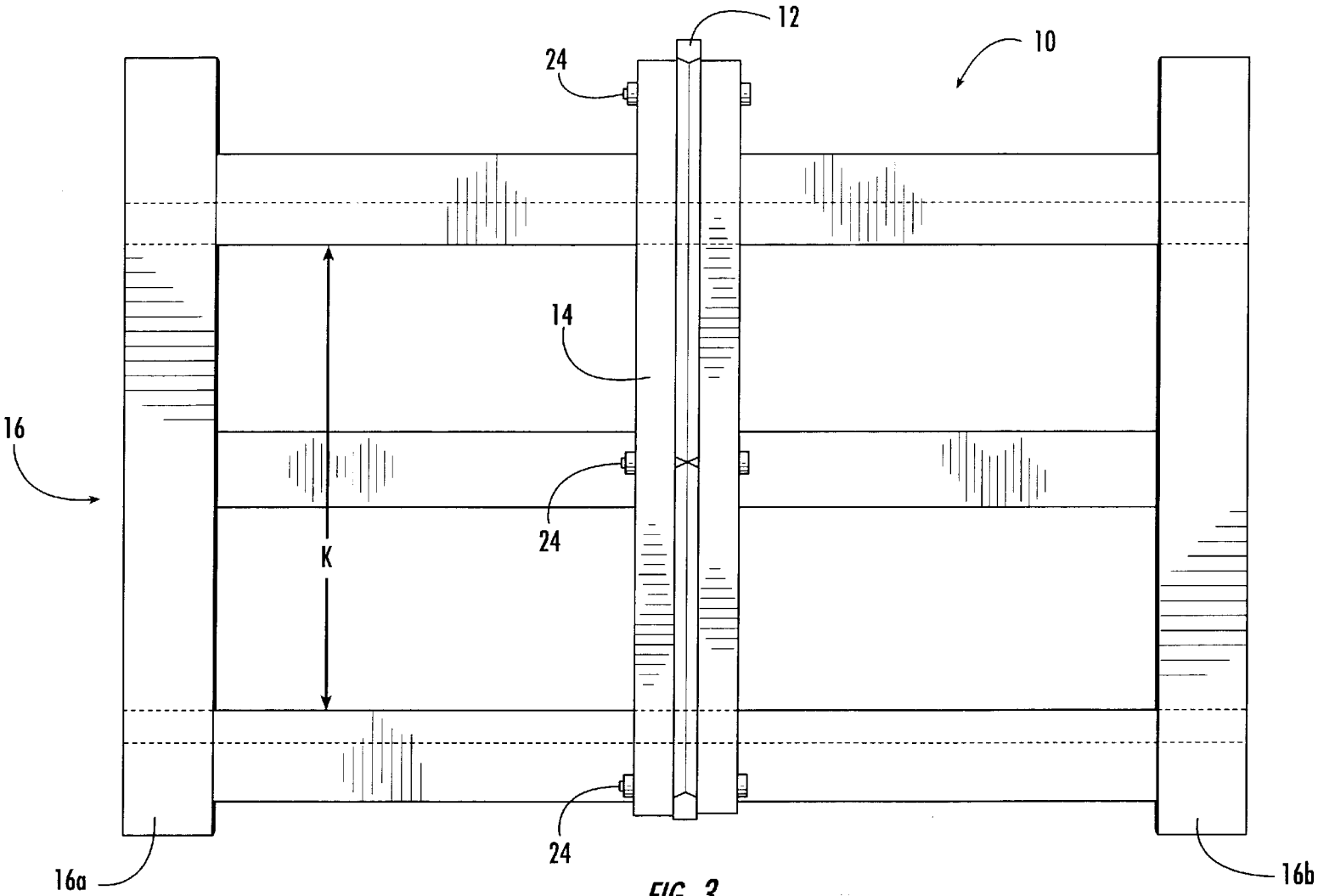
FIG. 3 is a front plan view of the attachment shown in FIGS. 1A and 1B.
Figure 4:
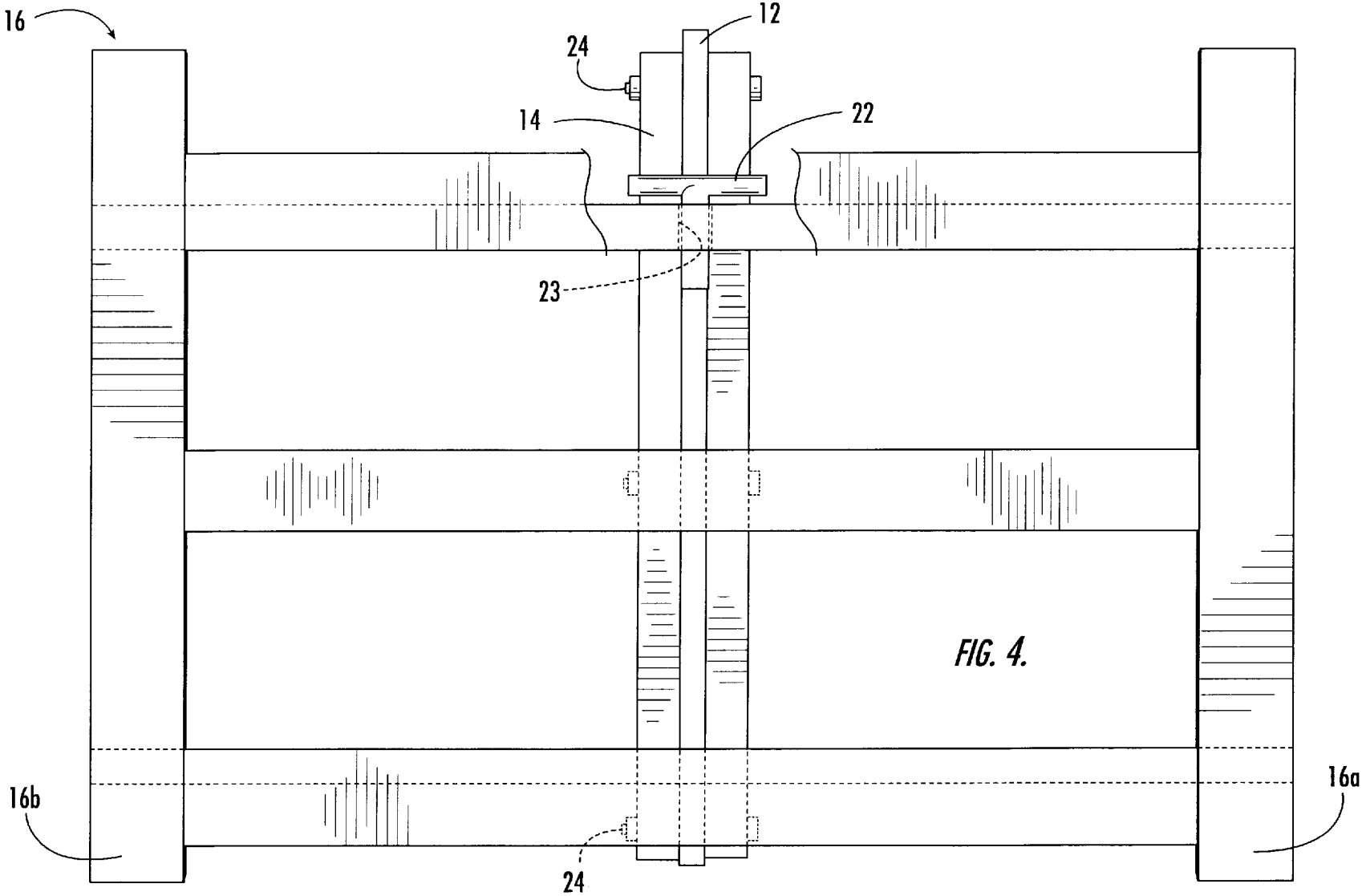
FIG. 4 is a rear plan view of the attachment shown in FIGS. 1A and 1B.

In this embodiment of the invention, the support 14 can have a width d of about 3 inches in the blade direction, and a length e of about 23 inches. The slot 20 in this embodiment desirably has a length k (FIG. 3) of about 15.5 inches, so as to correspond closely to the vertical dimension of a conventional forklift arm. As discussed above, the slot width is desirably tapered from a relatively wider width g (FIG. 1B) (that being the end the forklift arm enters first when being inserted into the attachment) to a relatively narrower end f (FIG. 1A). In the embodiment described here, the width f is about 1.5 inches, while the width g is about 3.5 inches.

The rear portion of the bracket 18 in the illustrated embodiment desirably has a height h of about 20 inches, with a portion of this rear portion on either end of the device extending vertically downward past the slot so as to enable the attachment 10 to stand upright for easy insertion of the forklift arm.

In operation, the attachment 10 is preferably positioned on the arm of the forklift, in the appropriate orientation (preferably so that the cutting edge of the blade is facing inwardly toward the other arm of the forklift), and the attachment is secured into place. For example, in the illustrated embodiment, the arm of the forklift is inserted into the slot formed by the bracket 18, and the T-pin is dropped into orifice 23 to secure the bracket tightly to the forklift arm (thereby operatively securing the blade to the forklift arm.) In a particularly preferred form of the invention, the forklift arm includes an orifice which is adapted to be co-axial with the orifice 23 when the attachment is secured onto the forklift arm in its operative position, and the T-pin has a length sufficient so that when it is inserted into orifice 23, it extends into the orifice in the forklift arm as well. In this way, the attachment 10 is secured against relative motion with respect to the forklift arm, and the attachment can move in concert with the forklift arm when the same is activated. Where the apparatus is manufactured so that the T-pin can extend into orifices in both the coupling device 16 and the forklift arm the orifice 23 in the coupling device can be formed so as to be elongate rather than rounded, so that alignment of the orifice of the coupling device with that of the forklift arm can be more readily and easily attained.

In one method of the invention, the attachment 10 can be positioned on the forklift arm by aligning the attachment in its upright position (coextensive with the forklift arm) so that the forklift operator need only drive the forklift forward to insert the forklift arm within the attachment. Alternatively, this positioning can be performed in other ways, such as by an operator manually lifting the attachment and sliding it onto the forklift arm, or by a forklift operator controlling the forklift so that it automatically extends the arm into the slot of the appropriate attachment. In a preferred method of operation, an attachment is desirably provided on each of the two arms of the forklift. To install the attachments, the operator need only position the attachments in front of each of the respective forklift arms, and drive the forklift forward such that each of the arms is inserted into its respective corresponding attachment.

Once the attachment(s) are installed on the forklift arm(s), the device is ready for use in severing the bands on the fiber bales. The forklift is simply driven toward a fiber bale so that the arms of the forklift are positioned along opposite sides of the bale, then the forklift is operated so that the arms of the forklift squeeze the bale on which the bands are to be cut. Because the cutting blade(s) 12 are facing inwardly toward the opposite forklift arm, the advancement of the forklift arms in their gripping direction causes the blades to proceed toward the bale(s) and the surrounding bands, with the force of the forklift arms closing together pressing the blades against the bands. In this way, the bands are severed with only minimal effort, with the forklift operator being spaced from the bale sufficiently to be out of harm's way from the flying ends of the severed band.

In some cases, the fiber bale to be opened will have a greater dimension in the cutting direction than the span of the attachment (e.g., the bale may have a height which is greater than the vertical length of the blade). In such a case, the operator need only grip the bale a plurality of times along the bale length, so that each of the bands is contacted by a blade during one of the squeezing operations. (As will be appreciated by those of ordinary skill in the art, in order to sever bands going in diverse directions, reorienting of the bale relative to the forklift may be required during the process.) At a minimum, however, the bands surrounding the bale in at least one direction can be readily and easily severed. Furthermore, and in particular where an attachment is secured to each of the two arms of the forklift, the forklift having the thus-secured attachments can be used to sever the bands around two fiber bales at once. For example, two bales can be placed side-by-side, with the arms of the forklift squeezing the two bales toward each other, while the portions of the band on the side of the bales remote from the other bale are severed.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An attachment for securement to a forklift having a pair of laterally movable arms for use in severing the bands surrounding fiber bales comprising:

a blade having a generally V-shaped cutting edge;

a support secured to said blade for supporting it in a rigid orientation;

a coupling device secured to said support and adapted for removable securement to an arm of a forklift such that when said coupling device is secured to the arm of a forklift, the cutting edge of the blade is oriented in the direction of gripping motion of the forklift arm, said coupling device further comprising means for releasably securing and stabilizing the attachment to the forklift arms.

2. An attachment according to claim 1, wherein said means for releasably securing and stabilizing the attachment to the forklift arms comprises a bracket having a slot-shaped opening therein, said opening being adapted for sliding receipt of an arm of a forklift.

3. An attachment according to claim 2, wherein said means for releasably securing and stabilizing the attachment to the forklift arms further includes a pin adapted for sliding engagement within an orifice to rigidly secure said bracket to the arm of a forklift.

4. An attachment and forklift combination comprising:

a forklift having a pair of arms adapted for gripping motion;

an individual attachment removably positioned on each of said forklift arms, each of said attachments including a support, a coupling device releasably securing the support to the forklift arm, and a blade secured to said support such that the blade extends substantially perpendicular to the plane of the arm of the forklift such that when said forklift arms are moved together in a gripping motion, the blade of each of said attachment is moved toward the other blade means for releasably securing and stabilizing the attachment to the forklift arms.

5. An attachment and forklift combination according to claim 1, wherein each blade has a generally V-shaped cutting edge.

6. An attachment and forklift combination according to claim 4 wherein said means for releasably securing and stabilizing the attachment to the forklift arms includes a bracket having a slot therein, with each of said forklift arms being inserted in the slot in its respective corresponding attachment.

7. An attachment and forklift combination according to claim 6, wherein said bracket on each of said attachments includes an orifice along its upper edge overlying a corresponding orifice in an upper edge of its corresponding forklift arm to thereby define a pair of overlying coaxial orifices, and further comprising a pin positioned in said pair of coaxial orifices to thereby further stabilize said forklift arm and its corresponding attachment from relative motion with respect to each other.

8. A method for removing the bands surrounding bales of fibers comprising the steps of:

positioning an individual attachment having a coupling device, a support secured to said coupling device and a blade secured to said support on each one of the two laterally movable arms of a forklift such that a cutting edge on the blade of each of the attachments faces toward the respective cutting edge of the blade of the attachment on the other forklift arm; and gripping two adjacent bales of fibers simultaneously with said forklift arms, to thereby cut the surrounding bands thereof.

* * * * *

UNITED STATES PATENT AND TRADEMARK OFFICE

CERTIFICATE OF CORRECTION

PATENT NO. : 6,200,084 B1
DATED : March 13, 2001
INVENTOR(S) : Self et al.

It is certified that error appears in the above-identified patent and that said Letters Patent is hereby corrected as shown below:

Column 8,
Line 26, "claim 1" should read -- claim 4 --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*